US008215820B2

(12) United States Patent
Howard et al.

(10) Patent No.: US 8,215,820 B2
(45) Date of Patent: Jul. 10, 2012

(54) LED NIGHT-LIGHT

(75) Inventors: Kenneth A. Howard, Creve Coeur, MO (US); Jim Riley, St. Louis, MO (US); Matthew S. Smith, St. Charles, MO (US)

(73) Assignee: Mary Elle Fashions, St. Louis, MO (US)

( * ) Notice: Subject to any disclaimer, the term of this patent is extended or adjusted under 35 U.S.C. 154(b) by 218 days.

(21) Appl. No.: 12/466,209

(22) Filed: May 14, 2009

(65) Prior Publication Data

US 2010/0290254 A1 Nov. 18, 2010

(51) Int. Cl.
*H01R 33/00* (2006.01)

(52) U.S. Cl. ..... 362/641; 362/650

(58) Field of Classification Search ..... 362/641–644, 362/650, 657–659, 249.02
See application file for complete search history.

(56) References Cited

U.S. PATENT DOCUMENTS

| | | | | |
|---|---|---|---|---|
| 3,968,355 | A | 7/1976 | Smallegan | |
| 4,343,032 | A * | 8/1982 | Schwartz | 362/276 |
| 4,714,984 | A | 12/1987 | Spector | |
| 5,339,231 | A * | 8/1994 | Parsolano et al. | 362/641 |
| D460,573 | S | 7/2002 | Gee, II | |
| D500,152 | S | 12/2004 | Stekelenburg | |
| 6,926,426 | B2 | 8/2005 | Currie | |
| D523,972 | S | 6/2006 | Chan | |
| D524,456 | S | 7/2006 | Yuen | |
| D524,457 | S | 7/2006 | Chan | |
| D524,458 | S | 7/2006 | Chan | |
| D524,956 | S | 7/2006 | Chan | |
| D525,376 | S | 7/2006 | Brady | |
| 7,114,821 | B2 | 10/2006 | Currie | |
| 7,455,444 | B2 | 11/2008 | Chien | |
| 7,568,829 | B2 | 8/2009 | Chien | |
| 7,632,004 | B2 | 12/2009 | Chien | |
| 2003/0185020 | A1 * | 10/2003 | Stekelenburg | 362/555 |
| 2004/0246704 | A1 | 12/2004 | Burdick | |
| 2006/0007709 | A1 * | 1/2006 | Yuen | 362/641 |
| 2006/0077684 | A1 | 4/2006 | Yuen | |
| 2006/0221617 | A1 | 10/2006 | Chien | |
| 2006/0237439 | A1 | 10/2006 | Norwood | |
| 2007/0076437 | A1 | 4/2007 | Chien | |
| 2007/0076439 | A1 | 4/2007 | Chien | |
| 2007/0076440 | A1 | 4/2007 | Chien | |
| 2007/0103901 | A1 | 5/2007 | Reid | |
| 2007/0132733 | A1 | 6/2007 | Ram | |
| 2007/0242485 | A1 | 10/2007 | Chien | |
| 2007/0253222 | A1 * | 11/2007 | Driska et al. | 362/641 |

OTHER PUBLICATIONS

International Search Report mailed Jul. 9, 2010 regarding PCT/US2010/034665, 3 pages.

* cited by examiner

*Primary Examiner* — Julie Shallenberger
(74) *Attorney, Agent, or Firm* — Senniger Powers LLP

(57) ABSTRACT

An LED night-light includes a housing with a threaded, cylindrical opening having an interior surface adapted to receive a threaded end of a light bulb. First and second prongs are supported in parallel by the housing. The prongs have interior ends extending into an interior of the housing and exterior ends extending out of the housing such that the exterior ends are configured to engage an electrical outlet. A disk is received in and supported by a groove in the interior surface. A light-emitting diode (LED) is mounted on the disk. The night-light further includes a circuit board including an LED driver circuit electrically connected to the LED. The driver circuit energizes the LED when the first and second prongs are plugged into an electrical outlet connected to a power source.

17 Claims, 9 Drawing Sheets

LED NIGHT-LIGHT

BACKGROUND OF THE INVENTION

The present invention generally relates to an LED (light-emitting diode) night-light, and more specifically to an LED night-light assembly configured from a typical night-light assembly for an incandescent bulb.

A typical night-light incandescent bulb includes of a glass envelope enclosing a filament. A plurality of support wires and connecting wires extend from the filament to an electrical contact. A screw cap is usually placed over the end of the glass envelope to facilitate connecting the bulb to a treaded socket of a housing for a standard night-light assembly. As shown in FIG. 1, a typical housing 1 of the prior art contains a body 3 having a threaded opening 5 for engaging the screw cap and a contact 7 electrically connecting to an electrical contact on the screw cap.

The housing used for LED's of the prior art are typically a different construction than those for standard light bulbs. The present invention allows for an LED to be used with a standard night-light assembly for an incandescent bulb, such as those having a threaded opening.

SUMMARY OF THE INVENTION

In one aspect of the present invention, an LED night-light generally comprises a housing having an interior surface defining a cylindrical opening. The interior surface has threads adapted to mate with a threaded end of a light bulb. The interior surface also has a groove. First and second prongs extend out of the housing and are configured for insertion into an electrical outlet. A disk is received in the groove of the interior surface of the housing. A light-emitting diode is mounted on the disk. An LED driver circuit is electrically connected to the LED. The driver circuit is configured for energizing the LED when the first and second prongs are inserted into an electrical outlet connected to a power source.

In another aspect of the invention, an LED night-light generally comprises a housing having a cylindrical interior surface defining an opening, and an upper rim surface surrounding the opening and defining a plane at the opening. The interior surface has threads adapted to mate with a threaded end of a light bulb. The interior surface also has a groove. A disk is in the groove. First and second prongs are supported in parallel by the housing. The prongs have interior ends extending into an interior of the housing and have exterior ends extending out of the housing such that the exterior ends are configured for insertion into an electrical outlet. A light-emitting diode is mounted on the disk and electrically connected to the first prong. The light-emitting diode extends through the plane defined by the upper rim surface of the housing, wherein a majority of the light-emitting diode is disposed below the plane defined by the upper rim surface of the housing. A circuit board includes an LED driver circuit electrically connected to the LED. The driver circuit is configured for energizing the LED when the first and second prongs are plugged into an electrical outlet connected to a power source.

In yet another aspect of the present invention, a housing for an LED night-light generally comprises a front panel and a back panel connected to the front panel. The panels together define an upper portion and a lower portion of the housing. The upper portion comprises a cylindrical interior surface defining an opening. The interior surface has threads adapted to mate with a threaded end of a light bulb and a groove for positioning a light-emitting diode in the opening.

Other features will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENTS

Figure 1:
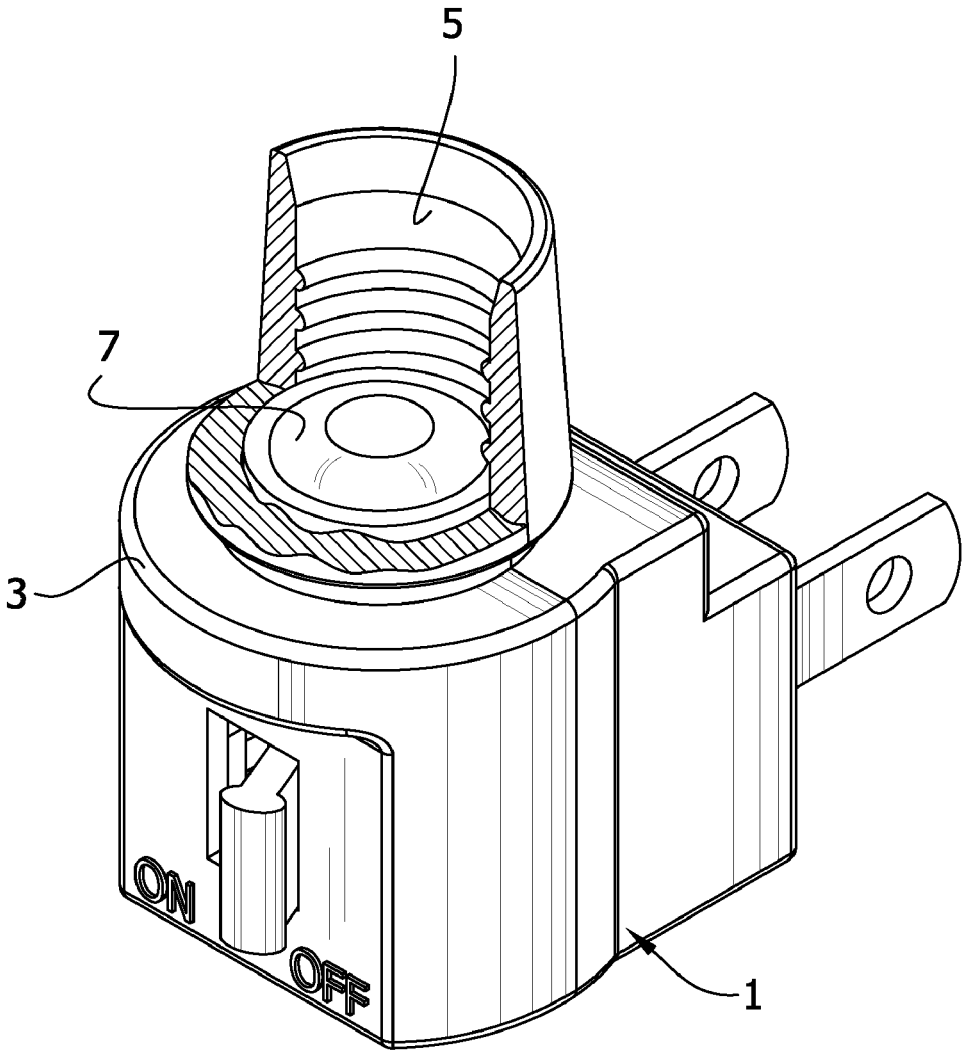
FIG. 1 PRIOR ART
FIG. 1 is a light assembly of the prior art.
Figure 2:
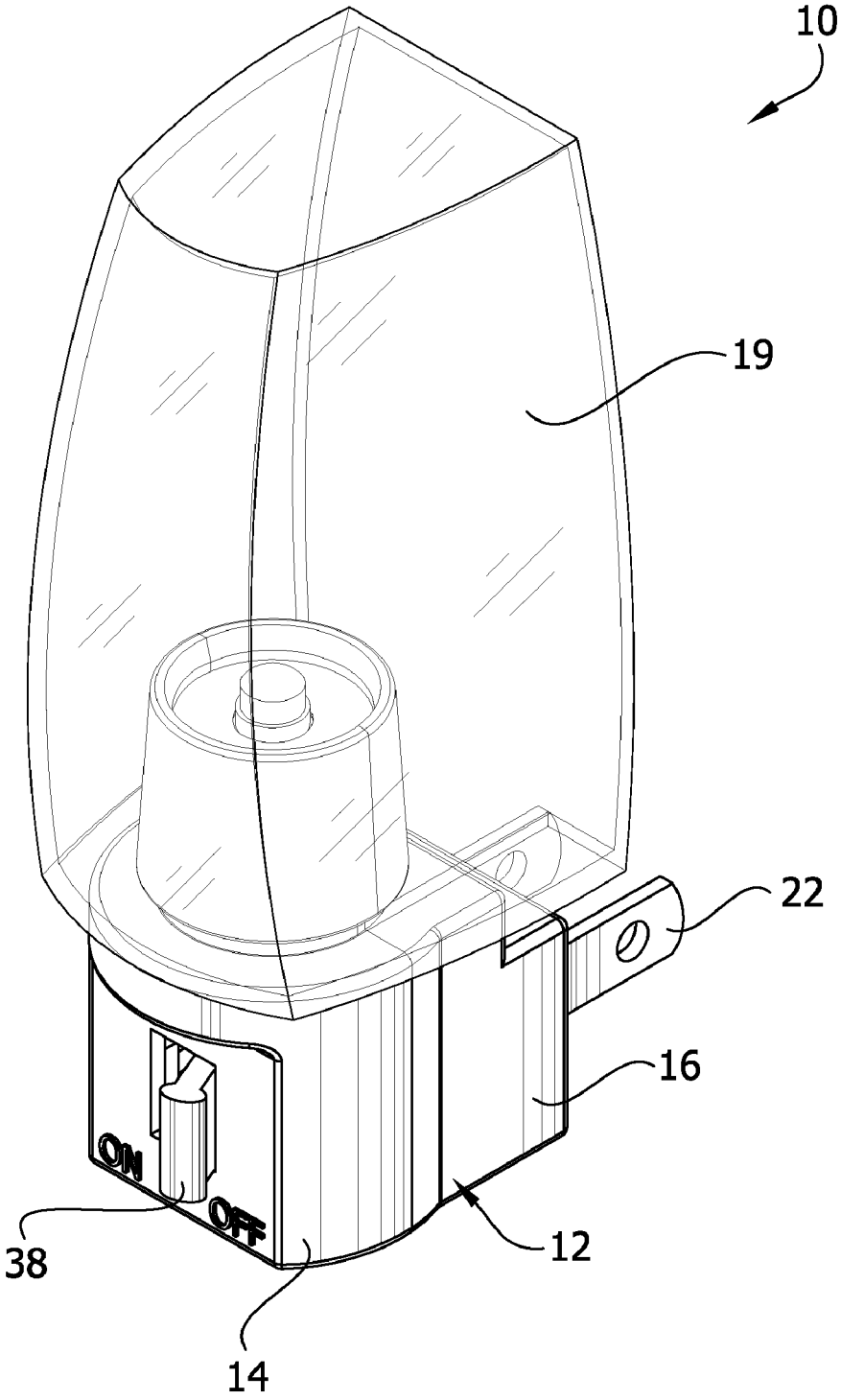
FIG. 2 is a perspective view of an embodiment of an LED night-light of the present invention.
Figure 4:
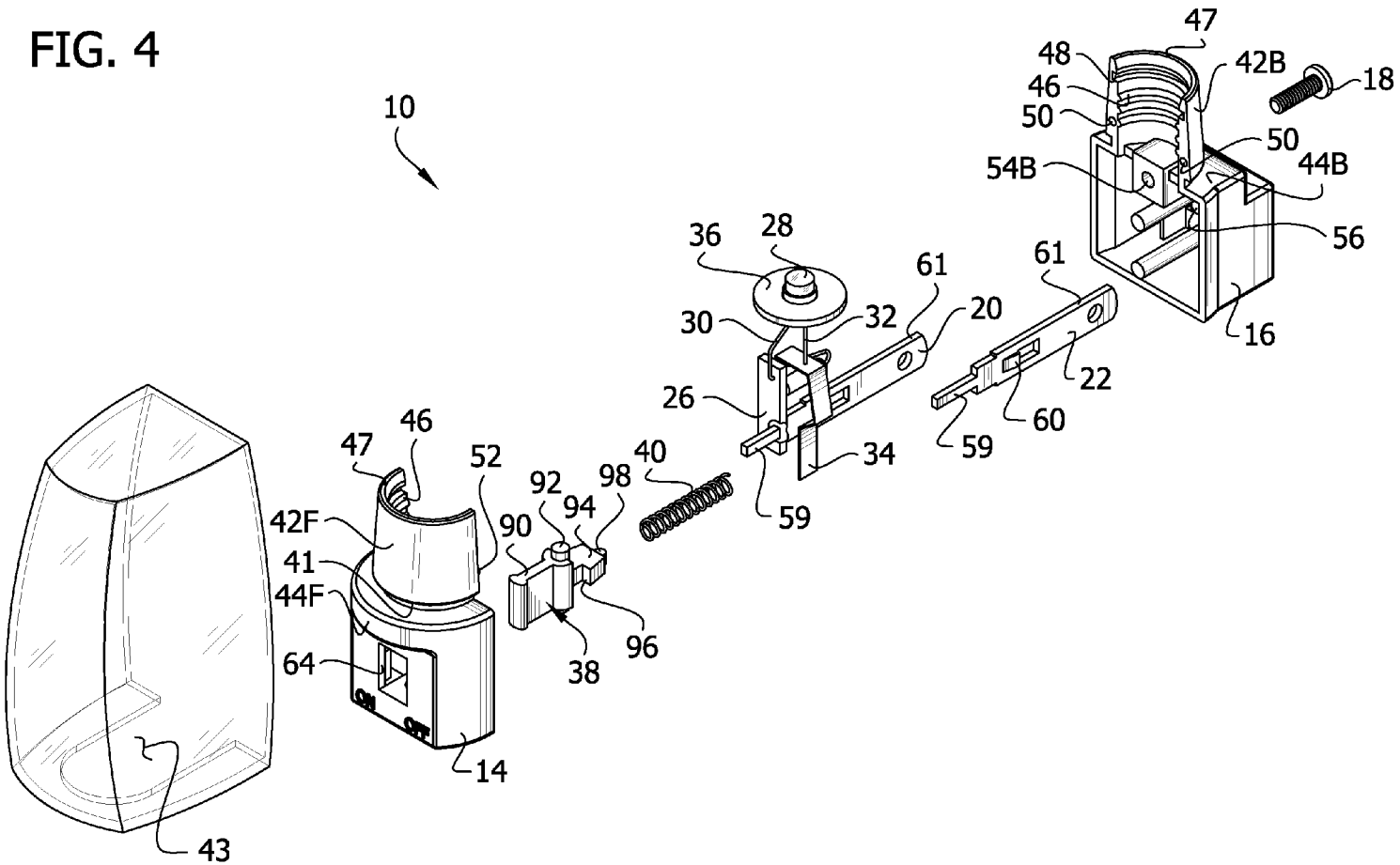
FIG. 4 is an exploded view of the LED night-light.
Figure 6:
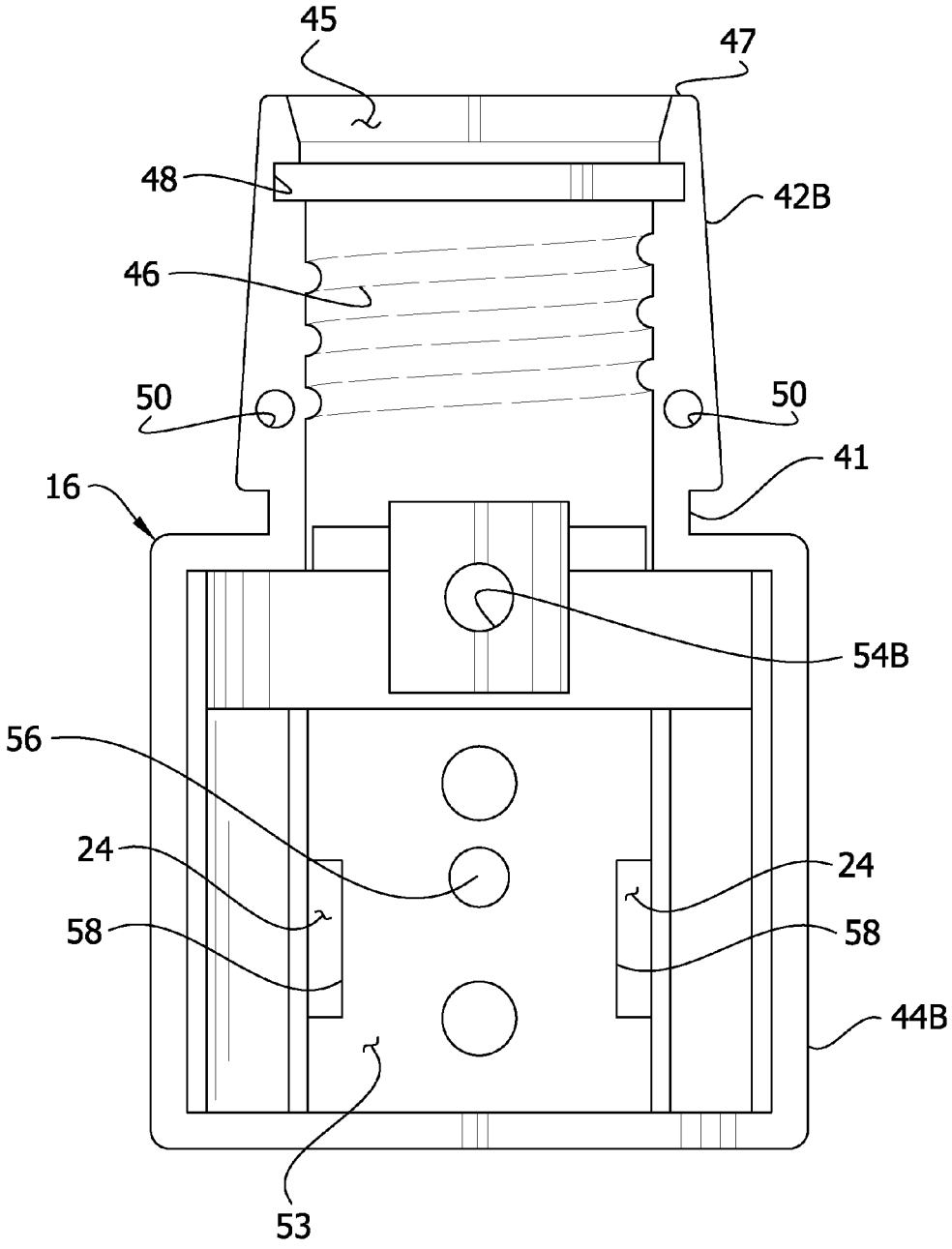
FIG. 6 is a front view of a back panel of a housing of the present invention.
Figure 7:
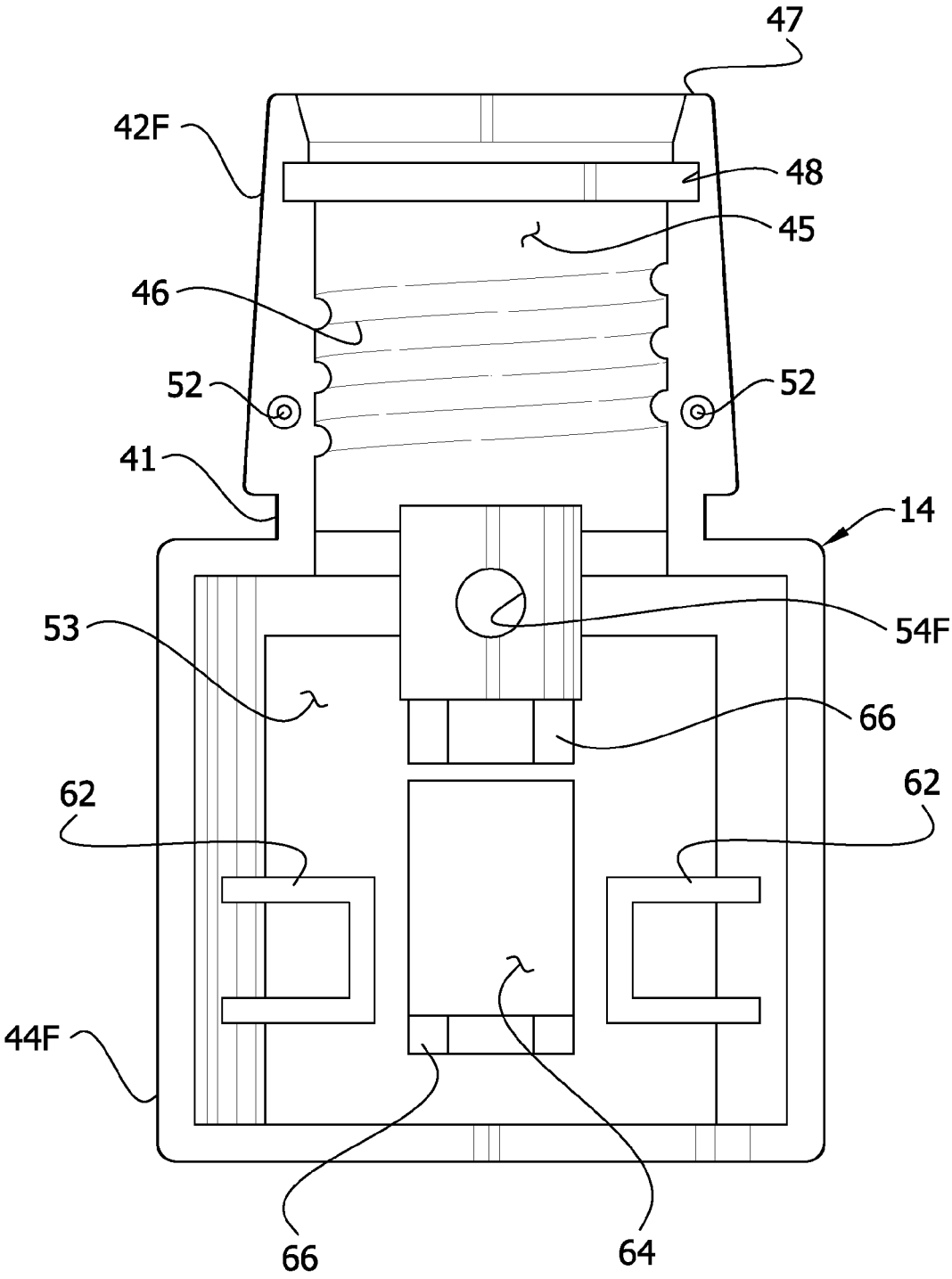
FIG. 7 is a back view of a front panel of the housing of the present invention.

Referring to FIGS. 2, 4 and 6, an LED night-light assembly of the present invention is generally indicated at 10. The assembly includes a housing 12 having a front panel 14 and a back panel 16 connected to the front panel by a screw 18. An optional transparent cover 19 is secured to the housing 12. First and second parallel prongs 20, 22 are supported by the housing 12 and are received through slots 24 in the back panel 16. A printed circuit board (PCB) 26 is mounted on the first prong 20. A light-emitting diode (LED) 28 has a first lead wire 30 connected to the PCB 26 and a second lead wire 32 extending from the LED 28 and attached to a spring 34. A disk 36 seats the LED 28. Holes (not shown) in the disk 36 receive the first and second connection wires 30, 32 allowing the wires to pass through the disk to connect to the PCB 26 and spring 34, respectively. A toggle switch 38 having a resilient extension 40 is mounted on the front panel 14. The toggle switch 38 is moveable for powering the assembly on and off when the prongs engage an electrical outlet connected to a power source.

Figure 3:
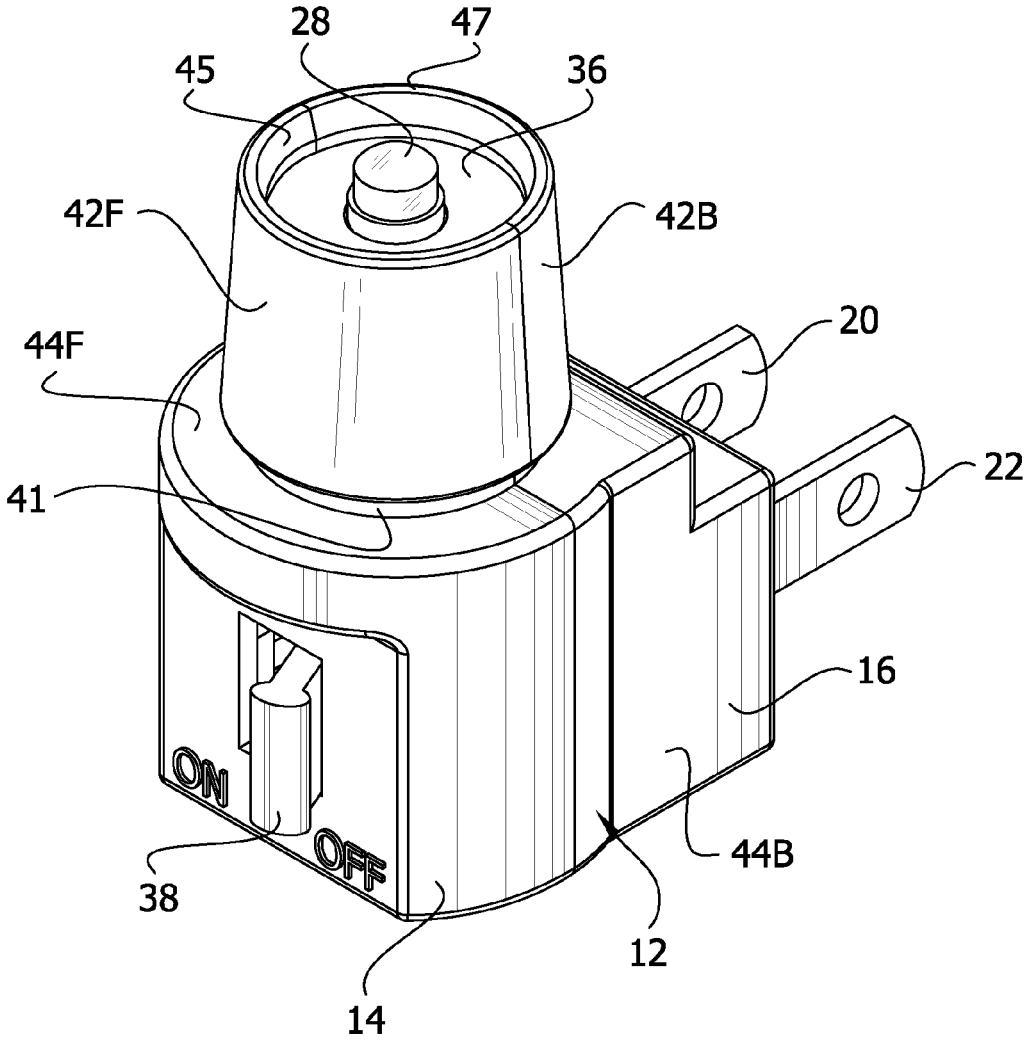
FIG. 3 is a perspective of the LED night-light with a cover removed.

Referring to FIGS. 2 and 3 each panel 14, 16 of the housing 12 has an upper portion 42F, 42B and a lower portion 44F, 44B. An annular channel 41 extends around the housing 12 between the upper and lower portions 42, 44. The optional cover 19 has a U-shaped cutout 43 which slides into the channel 41 for attaching the cover to the housing 12. It will be understood that the cover 19 can be attached to the housing 12 in any suitable manner and other covers or no cover may be used, within the scope of the present invention.

Referring to FIGS. 4-7, the upper portions 42F, 42B form a cylindrical housing for the LED 28. An opening 45 in the upper portion 42 of the housing 12 forms a rim 47 surrounding the opening and defining a plane P which is substantially horizontal when the night-light assembly 10 is vertical and engages a wall outlet. Threads 46 on an interior surface of the upper portion 42 are adapted to mate with a threaded end of a light bulb (not shown). The housing 11 has a modular configuration such that the housing is adapted to separately receive a light bulb and an LED.

The lower portion 44 of the housing 12 is more rectangular and houses, at least partially, the PCB 26, prongs 20, 22, spring 34, toggle switch 38 and extension 40 within an interior 53 of the housing. A bore 54F, 54B in the front and back panels 14, 16 receives the screw 18 by a threaded engagement for connecting the panels 14, 16. The back panel 16 has locating holes 50 configured to mate with locating pins 52 on the front panel 14 when the panels are connected. The back panel has a post 56 and a pair of sleeves 58 extending from an inner surface. The post 56 holds the extension 40 in place on the back panel 16. The sleeves 58 are sized and shaped to slideably receive interior ends 59 of the prongs 20, 22. When received in the sleeves 58, the prongs are supported in parallel by the housing 12. A catch 60 on the prongs 20, 22 prevents the prongs from sliding out the back of the back panel 16 once the prongs are inserted in the back panel 16. Exterior ends 61 of the prongs 20, 22 extend out of the housing 12 and are configured for insertion into an electrical outlet (not shown) connected to a power source. The front panel 14 has a pair of stops 62 formed in the front panel which prevent the prongs 20, 22 from being pushed and pulled with respect to the housing 12 when the panels are connected. The front panel 14 also has a window 64 and U-shaped supports 66 which receive the toggle switch 38. It is understood that the housing can have other configurations and still be within the scope of the present invention. For instance the housing could have other shapes or be formed from a single piece.

Figure 8:
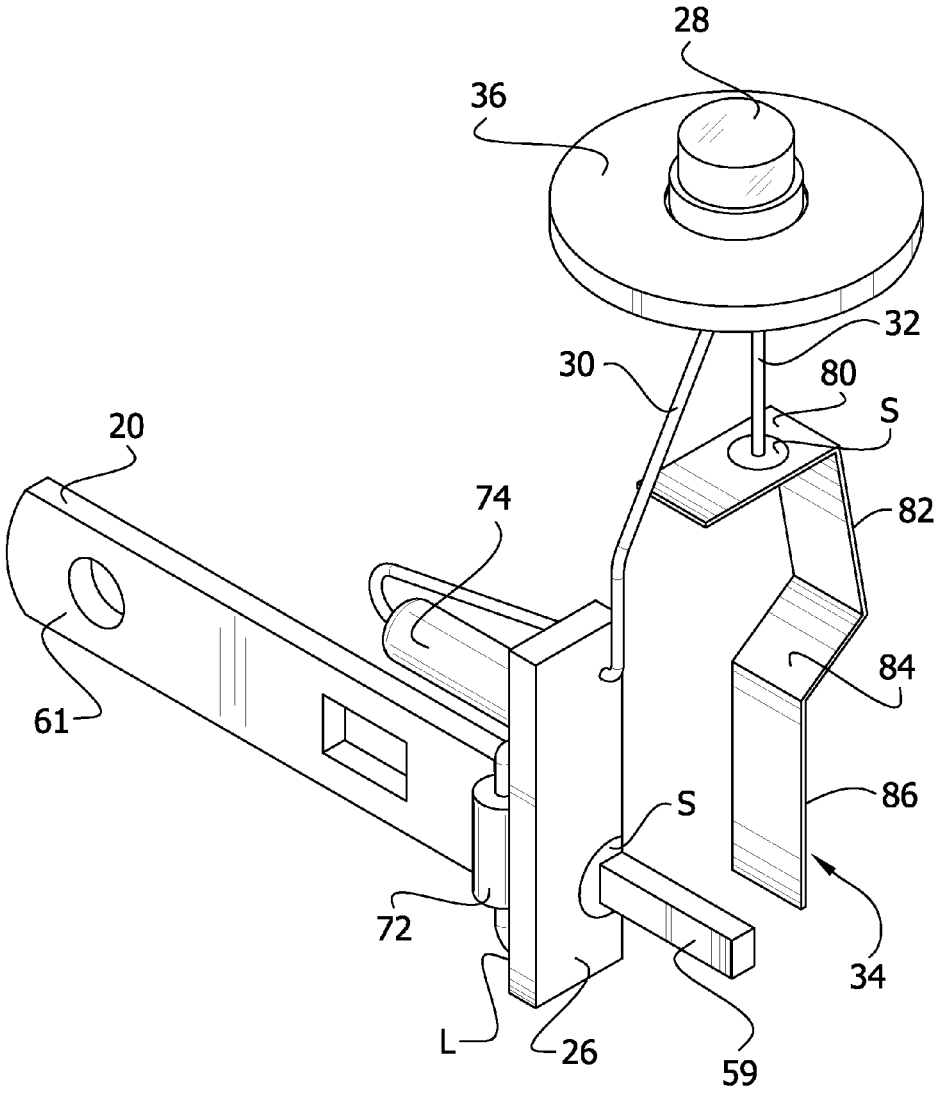
FIG. 8 is a perspective of an LED, circuit board and prong of the present invention.
Figure 9:
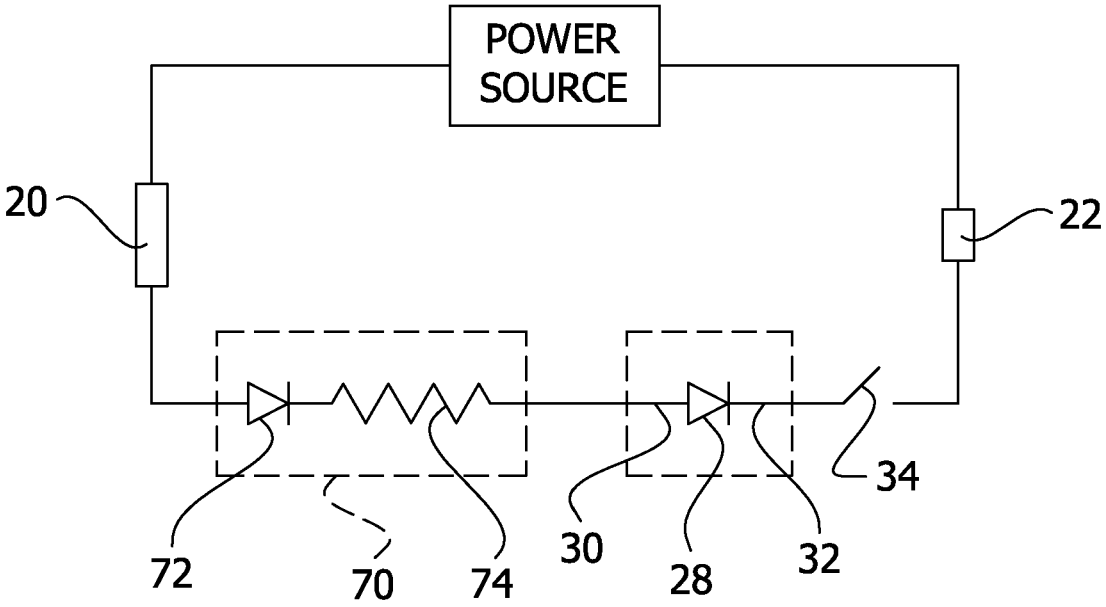
FIG. 9 is a schematic of a circuit of the LED night-light.

Referring to FIGS. 8 and 9, the PCB 26 comprises a rigid substrate having an electrically conductive surface layer L. The PCB 26 along with the conductive surface layer is mounted onto the first prong 20 by solder S which electrically interconnects the prong 20 and the layer L. Electrically connected to the PCB 26 is an LED driver circuit 70 comprising a rectifier (diode) 72 and a resistor 74 configured for energizing the LED 28 when the prongs 20, 22 engage an outlet connected to a power source. The diode 72 and resister 74 are connected in series between the first prong 20 and the LED 28. The LED 28 is also electrically connected to the PCB 26, in series with the resistor 74, via the first connection wire 30. The diode 72, resistor 74 and LED 28 are standard electrical components well known to those of skill in the art. The disk 36 supports the LED and is received in a groove 48 in the interior surface of the housing 12 for positioning the LED 28 in the housing (see FIG. 5). In the illustrated embodiment, the groove 48 is located above the threads 46. One advantage of embodiments having the threads 46 and groove 48 is that molds used to make a typical night-light assembly for an incandescent bulb may be easily modified by adding the groove 48 for the disk 36 supporting the LED 28. Thus, a typical night-light assembly for an incandescent bulb may be easily converted to an LED night light. It is also contemplated that the disk may be configured to engage one of the grooves defined by the threads 46.

The disk 36 positions the LED 28 such that a majority (e.g. at least 50% of the height) of the LED is located below the rim 47. In the illustrated embodiment, the LED is shown as extending out of the upper portion 42 of the housing 12 and through the plane P so that only the dome of the LED is above plane P. However, the LED can be located at other positions. One advantage of embodiments of the invention in which a substantial portion of the LED 28 is positioned below the rim 47 is that the cylindrical housing formed by the upper portions 42F, 42B create a shroud which blocks and reflects at least some of the light emitted by the LED 28. As a result, when the night light is mounted in a wall outlet at eye level, at least some horizontal light is blocked and reflected so that the LED 28 does not appear as bright or as a hot spot to an observer. Additionally, in the illustrated embodiment the disk is circular, however, the disk can have other shapes such as square or triangular and still be within the scope of the present invention.

Referring to FIG. 8, the spring 34 connected to the second connection wire 32 is formed from a bent piece of sheet metal. In the illustrated embodiment, the second connection wire 32 is electrically connected by solder S to the spring 34. The metal piece is bent to conform to the space in the interior 53 of the housing 12. A first spring portion 80 is positioned generally horizontally when the LED 28 is held in the housing 12. A second spring portion 82 extends from the first spring portion 80 generally vertically. A third spring portion 84 extends from the second spring portion 82 at an angle toward the center of the housing 12. The angle is sufficient to clear the second prong 22 such that a fourth spring portion 86 can extend from the third spring portion 84, generally vertically, between the second prong 22 and the extension 40. The spring 34 is moveable to electrically connect the LED 28 to the second prong 22. As will be described in greater detail below, the fourth portion 86 of the spring 34 is positioned to be engaged by the extension 40 on the toggle switch 38 for powering on and off the assembly 10. It should be understood, however, that other configurations and types of springs can be utilized within the scope of the present invention.

Referring to FIG. 4, the toggle switch 38 includes a handle 90, a bar 92 at the base of the handle and a retaining knob 94 extending from the bar having a pair of shoulders 96 (only one is shown). A projection 98 extends from the retaining knob 94 for attaching the switch 38 to the extension 40. The extension comprises a coil spring having a pair of open ends. When the toggle switch 38 is received through the window 64 in the front panel 14 of the housing 12 the bar 92 abuts the U-shaped supports 66, holding the toggle switch in the housing. The projection 98 inserts into one of the open ends of the extension 40 while the other open end of the extension fits around the post 56 on the back panel 16 of the housing 12. The extension 40 has a resting length such that when the panels 14, 16 are attached, the extension exerts a spring force on the toggle switch 38 holding the bar 92 in contact with the supports 66 allowing the toggle switch to pivot back and forth (e.g. left or right when the prongs engage a wall outlet). The illustrated embodiment shows the toggle switch formed from one solid piece of electrically non-conductive material; however the toggle switch can comprise multiple components attached by any suitable manner. Moreover, other configurations of toggle switches and other types of switches are within the scope of the present invention. Thus, the toggle switch assembly comprises the toggle switch 38 and extension 40.

Figure 5:
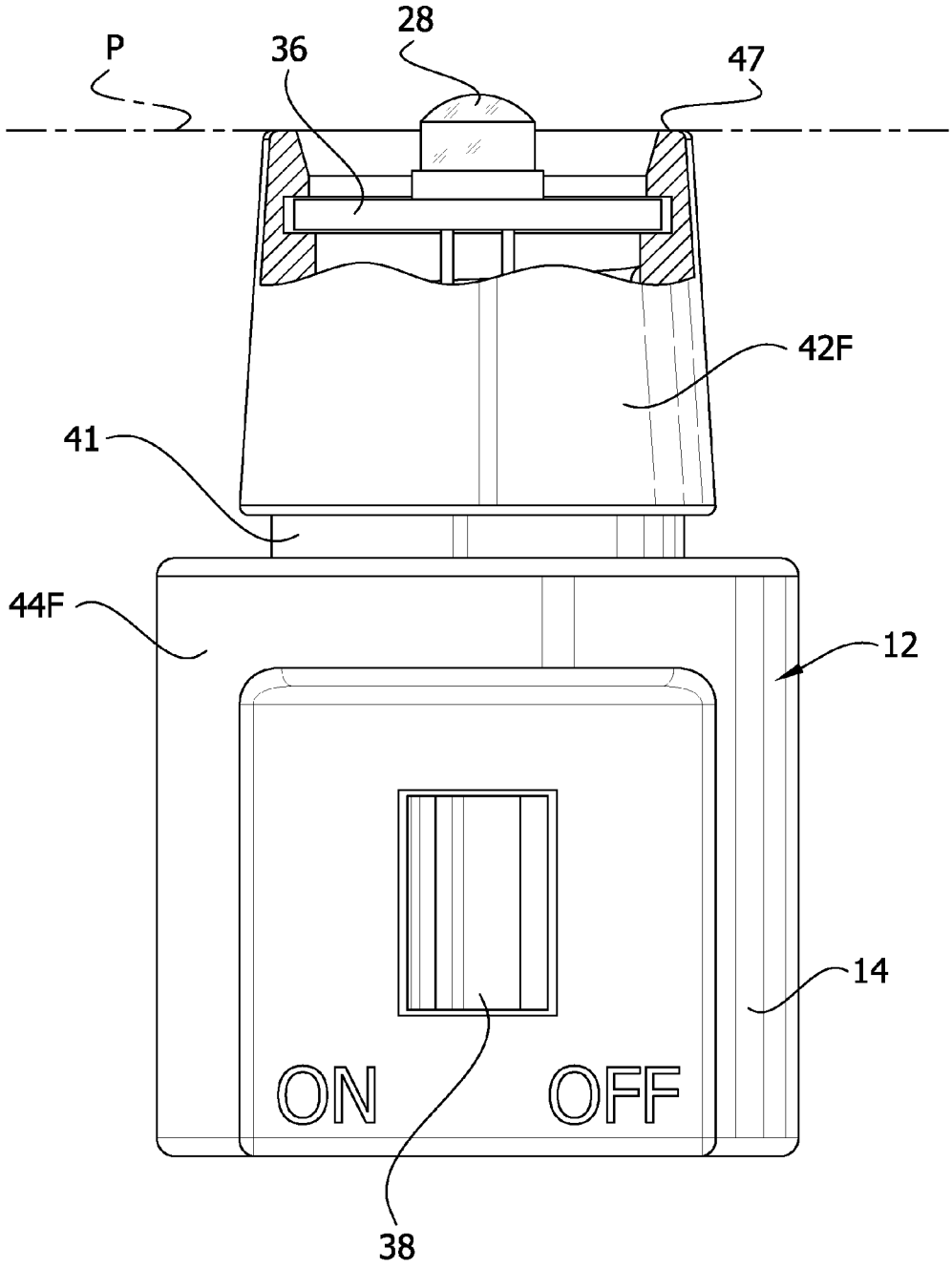
FIG. 5 is a front view of the perspective of FIG. 3.

In operation, the toggle switch 38 can be moved to a first position by toggling the switch to the left as shown in FIG. 5, labeled "ON". In this position, the extension 40 will engage the fourth portion 86 of the spring 34 causing the spring to contact the second prong 22. If the assembly 10 is connected to a power source, the spring 34 contacting the prong 22 will close the circuit, as shown by the switch in FIG. 9, energizing the driver circuit 70 and LED 28, powering on the LED.

The toggle switch 38 can also be moved to a second position by toggling the switch to the right, in the position labeled "OFF". In this position, the extension 40 will release engagement with the fourth portion 86 of the spring 34 allowing the spring to move back to its resting position away from the second prong 22. This will open the circuit, de-energizing the driver circuit 70 and LED 28, powering off the LED.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions and methods without departing from the scope of the invention, it is intended that all matter contained in the above description and shown in the accompanying drawings shall be interpreted as illustrative and not in a limiting sense.

What is claimed is:

1. An LED night-light comprising:

a housing having an interior surface defining a cylindrical opening, the interior surface having threads adapted to mate with a threaded end of a light bulb, and a groove;

first and second prongs extending out of the housing and configured for insertion into an electrical outlet;

a disk received in the groove of the interior surface of the housing;

a light-emitting diode mounted on the disk; and an LED driver circuit electrically connected to the LED, said driver circuit configured for energizing the LED when the first and second prongs are inserted into an electrical outlet connected to a power source, wherein the LED is free of threads such that the threads on the interior surface of the housing are not engaged by threads associated with the LED.

2. An LED night-light as set forth in claim 1 further comprising a circuit board, wherein the LED driver circuit is mounted on the circuit board to electrically connect to the LED driver circuit to the circuit board, and wherein a solder electrically connects the first prong to the circuit board such that the light-emitting diode, disk, circuit board and first prong are a self-contained unit.

3. An LED night-light as set forth in claim 2 wherein the driver circuit comprises a diode and a resistor connected in series between the first prong and the LED.

4. An LED night-light set forth in claim 3 wherein the light-emitting diode extends out of the opening.

5. An LED night-light set forth in claim 4 wherein the housing is defined exclusively by structure that at least partially houses the LED driver circuit and does not include a shade or cover attachable to the housing, and wherein a majority of the light-emitting diode is disposed in the opening.

6. An LED night-light as set forth in claim 1 wherein the housing comprises a front panel and a back panel, the prongs being slideably received through the back panel.

7. An LED night-light as set forth in claim 6 further comprising a first wire connected to the LED and electrically connected to the driver circuit, a second wire connected to the LED and selectively electrically connectable to the second prong via movement of a toggle switch, wherein the toggle switch is mounted on the front panel and is moveable between a first position and a second position wherein movement of the switch to the first position completes a closed circuit and electrically connects the second wire to the second prong, said movement of the switch to the first position energizing the driver circuit and the LED when the first and second prongs are connected to an electrical outlet connected to a power source and wherein movement of the switch to the second position creates an open circuit such that the second wire is not electrically connected to the second prong so that the LED is open-circuited and the driver circuit and LED are not energized when the first and second prongs are connected to a power source.

8. An LED night-light as set forth in claim 7 further comprising a metal spring connected to the second wire, the toggle switch being moveable to engage the spring with the second prong to create a closed circuit and energize the LED and driver circuit when the prongs are connected to an electrical outlet.

9. An LED as set forth in claim 8 wherein the spring comprises a piece of bent sheet metal having a first portion positioned generally horizontally when the light-emitting diode is mounted in the housing, a second portion extending from the first portion generally vertically, a third portion extending from the second portion at an angle other than 180 degrees toward a center of the housing and a fourth portion extending from the third portion generally vertically.

10. An LED night-light comprising:

a housing having a cylindrical interior surface defining an opening, and an upper rim surface surrounding the opening and defining a plane at the opening, the interior surface having threads adapted to mate with a threaded end of a light bulb, and a groove;

first and second prongs supported in parallel by the housing, said prongs having interior ends extending into an interior of the housing and having exterior ends extending out of the housing such that the exterior ends are configured for insertion into an electrical outlet;

a disk in the groove;

a light-emitting diode mounted on the disk and electrically connected to the first prong, the light-emitting diode extending through the plane defined by the upper rim surface of the housing, wherein a majority of the light-emitting diode is disposed below the plane defined by the upper rim surface of the housing;

a circuit board including an LED driver circuit electrically connected to the LED, said driver circuit being configured for energizing the LED when the first and second prongs are plugged into an electrical outlet connected to a power source;

wherein the housing is defined exclusively by structure that at least partially houses the circuit board and does not include a shade or cover attachable to the housing.

11. An LED night-light as set forth in claim 10 wherein the housing comprises a front panel and a back panel.

12. An LED night-light as set forth in claim 11 wherein the prongs are slideably received through the back panel of the housing.

13. An LED night-light as set forth in claim 12 further comprising a first wire connected to the LED and electrically connected to the driver circuit, a second wire connected to the LED and selectively electrically connectable to the second prong via movement of a toggle switch, wherein the toggle switch is mounted on the front panel and is moveable between a first position and a second position wherein movement of the switch to the first position completes a closed circuit and electrically connects the second wire to the second prong, said movement of the switch to the first position energizing the driver circuit and the LED when the first and second prongs are connected to an electrical outlet connected to a power source and wherein movement of the switch to the second position creates an open circuit such that the second wire is not electrically connected to the second prong so that the LED is open-circuited and the driver circuit and LED are not energized when the first and second prongs are connected to a power source.

14. An LED night-light as set forth in claim 13 further comprising a metal spring connected to the second wire, the toggle switch being moveable to engage the spring with the second prong for energizing the driver circuit and the LED when the prongs are connected to a power source.

15. An LED night-light as set forth in claim 1 wherein the groove is separate and apart from the threads and the disk does not engage the threads in the interior space.

16. An LED night-light as set forth in claim 1 wherein the disk directly engages the groove in the housing.

17. An LED night-light comprising:

a housing having an interior surface defining a cylindrical opening, the interior surface having threads adapted to mate with a threaded end of a light bulb, and a groove;

first and second prongs extending out of the housing and configured for insertion into an electrical outlet;

a disk received in the groove of the interior surface of the housing;

a light-emitting diode mounted on the disk;

an LED driver circuit electrically connected to the LED, said driver circuit configured for energizing the LED when the first and second prongs are inserted into an electrical outlet connected to a power source; and a circuit board, wherein the LED driver circuit is mounted on the circuit board to electrically connect to the LED driver circuit to the circuit board, and wherein a solder electrically connects the first prong to the circuit board such that the light-emitting diode, disk, circuit board and first prong are a self-contained unit.

* * * * *